US007497656B2

(12) United States Patent
Burhenne et al.

(10) Patent No.: US 7,497,656 B2
(45) Date of Patent: Mar. 3, 2009

(54) SUPPLY PUMP

(75) Inventors: Sabine Burhenne, Bretten (DE); Johannes Deichmann, Alheim-Sterkelshausen (DE); Bernd Jaeger, Fritzlar (DE); Karsten Meiser, Frielendorf (DE)

(73) Assignee: Siemens Aktiengesellschaft, München (DE)

( * ) Notice: Subject to any disclaimer, the term of this patent is extended or adjusted under 35 U.S.C. 154(b) by 879 days.

(21) Appl. No.: 10/489,002

(22) PCT Filed: Aug. 29, 2002

(86) PCT No.: PCT/DE02/03170

§ 371 (c)(1),
(2), (4) Date: Mar. 5, 2004

(87) PCT Pub. No.: WO03/021109

PCT Pub. Date: Mar. 13, 2003

(65) Prior Publication Data

US 2004/0247426 A1 Dec. 9, 2004

(30) Foreign Application Priority Data

Sep. 6, 2001 (DE) ..... 101 43 809

(51) Int. Cl.
*F04D 5/00* (2006.01)

(52) U.S. Cl. ..... 415/55.1

(58) Field of Classification Search ..... 415/55.1, 415/55.2, 55.3, 55.5, 55.6, 55.7
See application file for complete search history.

(56) References Cited

U.S. PATENT DOCUMENTS

| | | | | |
|---|---|---|---|---|
| 5,257,916 | A * | 11/1993 | Tuckey | 417/423.3 |
| 5,375,971 | A | 12/1994 | Yu | |
| 6,443,693 | B1 | 9/2002 | Eck | |
| 6,481,958 | B1 | 11/2002 | Wilhelm et al. | |

FOREIGN PATENT DOCUMENTS

| | | | |
|---|---|---|---|
| EP | 0 070 529 | A1 | 1/1983 |
| EP | 0 646 727 | B1 | 4/1995 |
| EP | 1 103 723 | A2 | 5/2001 |
| JP | 59141795 | | 8/1984 |
| JP | 09079168 | | 3/1997 |
| WO | WO 01/20169 | A1 | 3/2001 |

OTHER PUBLICATIONS

J. B. Calvert, "Ellipse", University of Denver, May 6, 2002 <http://www.du.edu/~jcalvert/math/ellipse.htm>.*

* cited by examiner

*Primary Examiner*—Edward Look
*Assistant Examiner*—Nathaniel Wiehe
(74) *Attorney, Agent, or Firm*—Cohen Pontani Lieberman & Pavane LLP

(57) ABSTRACT

The invention relates to a supply pump embodied as a side channel pump, whereby several sections (14-16) forming the cross-section of a supply chamber (13) each comprise radii. The origins of the external radii are arranged on the front face of a pump housing facing the one rotor. The sections (14-16) comprise common tangents in the adjacent regions thereof. A particularly high efficiency for the supply pump can thus be guaranteed.

5 Claims, 1 Drawing Sheet

SUPPLY PUMP

PRIORITY CLAIM

This is a U.S. national stage of application No. PCT/DE02/03170, filed on 29 Aug. 2002. Priority is claimed on that application and on the following application(s): Country: Germany, Application No.: 101 43 809.5, Filed: 6 Sep. 2001.

BACKGROUND OF THE INVENTION

1. Field of the Invention

The invention relates to a supply pump having a driven impeller which rotates in a pump housing, the impeller having at least one ring of vane chambers, and the supply pump having a partially annular channel which is arranged in the wall of the pump housing lying opposite the ring of vane chambers and extends from an inlet channel to an outlet channel, the cross section of the partially annular channel having a plurality of sections.

2. Description of the Prior Art

Supply pumps of this type are frequently used as fuel pumps and are known from practice. The design of the cross section of the partially annular channel with a plurality of sections is intended to enable the supply chamber, which is composed of the partially annular channel and the vane chambers, to be adapted to the circulating flow produced therein. In the case of the supply pump known from practice, at least one of the sections has a flat side, so that the circulating flow is at an alternating distance from the wall of the partially annular channel.

A disadvantage of the known supply pump is that at the transitions of the sections, and therefore in the regions in which the circulating flow is at a particularly large distance from the wall of the partially annular channel, vortices arise which result in a severe reduction in the efficiency of the supply pump.

In order to avoid the turbulence, a supply pump which is disclosed in U.S. Pat. No. 5,375,971 includes a cross section of the supply chamber designed as part of an ellipse, the depth of the partially annular channel being less than half of the minor axis of the ellipse. By this means, flat sections are avoided in the region of the supply chamber. However, the disadvantage of this supply pump is that turbulence arises in the partially annular channel, in the inlet region and in the outlet region of the circulating flow, since the supply chamber forms tapering pockets particularly in regions which are adjacent to the vane chambers, and the circulating flow is therefore at a variable distance from the wall of the partially annular channel. Furthermore, the elliptical design of the cross section of the partially annular channel can be manufactured only with very great difficulty.

SUMMARY OF THE INVENTION

It is an object of the present invention to provide a supply pump such that turbulence in a partially annular channel arranged opposite a ring of vane chambers in a driven impeller is avoided and that the supply pump is particularly efficient.

This problem is solved according to the invention by each of a plurality of sections of the annular channel being formed by a radius.

This design enables the supply chamber to be adapted in a simple manner to the circulating flow of the medium to be supplied and to the viscosity thereof. However, variable distances between the circulating flow can be avoided in a simple manner. Turbulence within the supply pump is therefore reliably avoided. The supply pump according to the invention is therefore particularly efficient. A further advantage of this design is that a suitable selection of the radii and of the sections enables the optimum efficiency to be set to the operating point of the supply pump.

According to an advantageous development of the invention, a contribution is made to further reducing the turbulence within the circulating flow if the radii of the sections merge tangentially into one another.

According to another advantageous development of the invention, turbulence is reliably avoided in the region in which the circulating flow enters into the partially annular channel and exits therefrom if the origin of the radii of the outermost sections is arranged essentially on the plane of the end side of the pump housing facing the impeller. By this means, the outer sections are arranged, in their regions adjacent to the vane chambers, at right angles to the end side of the impeller. The flow therefore passes without turbulence from the vane chambers into the partially annular channel.

The supply pump according to the invention can be manufactured particularly cost-effectively by a total of three to five sections.

A contribution is made to further increasing the efficiency of the supply pump according to the invention if the sections are arranged symmetrically to one another.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 1:
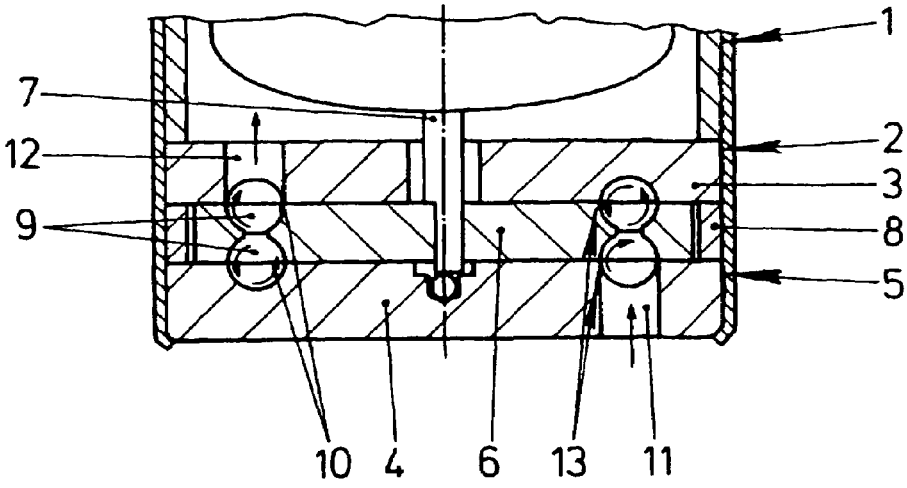
FIG. 1 is a longitudinal sectional view of a supply pump according to an embodiment of the present invention.

FIG. 1 shows a supply pump 2 which is driven by an electric motor 1 and is designed as a side channel pump. A supply pump 2 of this type can be used, for example, for supplying fuel in a modern motor vehicle. The supply pump 2 has an impeller 6 which is driven between two housing parts 3, 4 of a pump housing 5. The impeller 6 is fastened for this purpose on a shaft 7 of the electric motor 1. The housing parts 3, 4 of the pump housing 5 are kept at a distance by means of an annular spacer 8. The end sides of the impeller 6 each have a ring of vane chambers 9. Partially annular channels 10 are arranged in those regions of the housing parts 3, 4 which lie opposite the rings of the vane chambers 9. The vane chambers 9 and the partially annular channels 10 form supply chambers 13 extending from an inlet channel 11 to an outlet channel 12 of the supply pump 2. When the impeller 6 is driven by the electric motor 1, a medium is sucked up through the inlet channel 11 and guided via the supply chambers to the outlet channel 12. Circulating flows form within the supply chambers 13. For clarification purposes, the flows of the supplied medium are indicated by arrows in the drawing.

Figure 2:
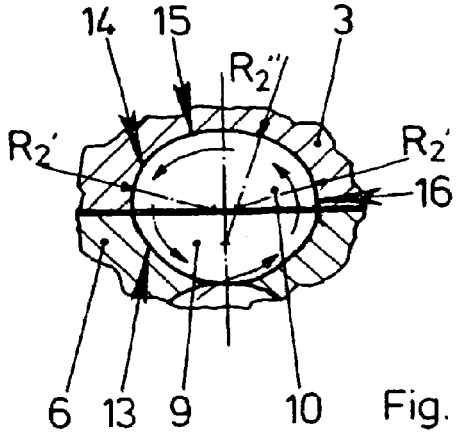
FIG. 2 is a enlarged sectional view of region of an annular channel of the supply pump of FIG. 1.

FIG. 2 shows, in a greatly enlarged illustration, a cross section of one of the supply chambers 13 from FIG. 1. The vane chambers 9 in the impeller 6 have an approximately semicircular or semi-elliptical cross section. The cross section of the channel surface of the housing defining the partially annular channel 10 has three sections 14-16 each having a radius $R_2'$, $R_2''$. The origin of the two outer radii $R_2'$ is situated on the end side of the housing part 3 while the origin of the middle radius $R_2''$ lies on the axis of symmetry of the partially annular channel 10 which is perpendicular to the end side of the housing part 3. On the mutually adjacent regions, the sections 14-16 each have a common tangent. In the embodiment illustrated, the two outer radii $R_2'$ have approximately the radius 1.4 units of length while the middle radius $R_2''$ is 1.6.

Figure 3:
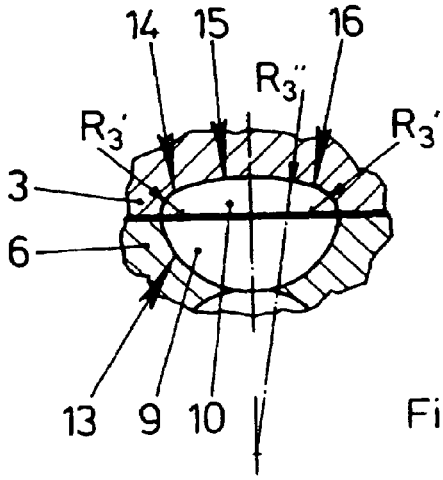
FIG. 3 is an enlarged sectional view of a further region of the annular channel of the supply pump of FIG. 1.
Figure 4:
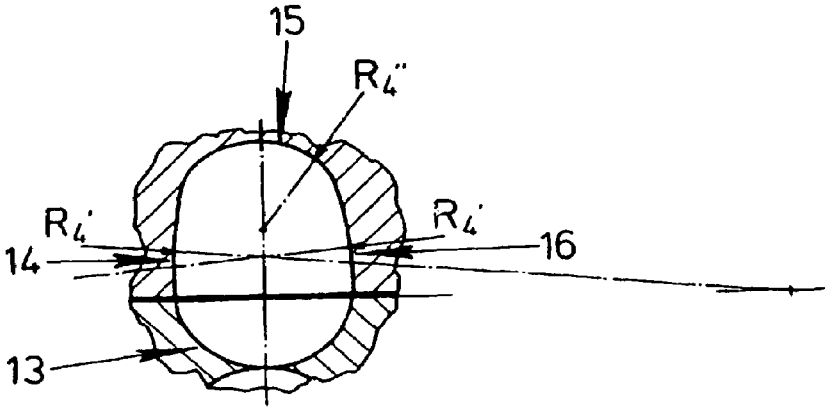
FIG. 4 is an enlarged sectional view of yet another region of the annular channel of the supply pump of FIG. 1.

FIG. 3 shows a further embodiment of the supply chamber 13 from FIG. 1 in cross section, the embodiment differing from that from FIG. 2 by the fact that the radii $R_3'$ of the two outer sections 14, 16 are in each case 0.3 units of length while the middle section 15 has a radius $R_3''$ of 8 units of length. FIG. 4 likewise shows a further embodiment of the supply chamber 13 from FIG. 1 in cross section, in which the radii $R_4'$ of the outer sections 14, 16 are each 10 units of length and the middle section 15 has a radius $R_4''$ of 1.4 units of length.

What is claimed is:

1. A supply pump, comprising:

a pump housing; and a driven impeller rotatably arranged in said pump housing, at least one ring of vane chambers being defined on said impeller, wherein said pump housing includes an inlet channel, an outlet channel, and a channel surface defining a partially annular channel opposing said at least one ring of vane chambers and extending from said inlet channel to said outlet channel, and wherein said partially annular channel has a cross section including a plurality of sections, each section of said plurality of sections having a constant radius, every two adjacent sections of said plurality of sections having different radii.

2. The supply pump of claim 1, wherein every two adjacent sections of said plurality of sections merge tangentially.

3. The supply pump of claim 1, wherein the origin of the radii of sections of said plurality sections that are adjacent to said ring of vane chambers is arranged essentially on a plane of a housing surface of said housing facing said ring of vane chambers.

4. The supply pump of claim 1, wherein said cross section includes three to five sections.

5. The supply pump of claim 1, wherein said sections are symmetric relative to a line normal to a face of said impeller on which said vane chambers are defined.

* * * * *